US008424637B2

(12) United States Patent
Lenz, Jr.

(10) Patent No.: US 8,424,637 B2
(45) Date of Patent: Apr. 23, 2013

(54) SYSTEMS AND METHODS FOR PROVIDING AN ASYMMETRIC CELLULAR ACOUSTIC DIFFUSER

(76) Inventor: Richard L. Lenz, Jr., Kaysville, UT (US)

( * ) Notice: Subject to any disclaimer, the term of this patent is extended or adjusted under 35 U.S.C. 154(b) by 120 days.

(21) Appl. No.: 12/986,871

(22) Filed: Jan. 7, 2011

(65) Prior Publication Data

US 2011/0168484 A1 Jul. 14, 2011

Related U.S. Application Data

(60) Provisional application No. 61/293,601, filed on Jan. 8, 2010.

(51) Int. Cl.
*E04B 1/82* (2006.01)
*E04B 1/74* (2006.01)

(52) U.S. Cl.
USPC ..... 181/288; 181/293

(58) Field of Classification Search ..... 181/288, 181/293, 285, 284, 210, 30; 52/144, 145
See application file for complete search history.

(56) References Cited

U.S. PATENT DOCUMENTS 1,877,964 A * 9/1932 Purser ..... 52/674
2,337,525 A * 12/1943 Peik ..... 428/136
2,459,121 A * 1/1949 Willey et al. ..... 181/293
2,699,599 A * 1/1955 Potchen ..... 428/604
2,779,429 A * 1/1957 Mazer et al. ..... 181/293
2,840,179 A * 6/1958 Junger ..... 181/286
3,035,657 A * 5/1962 Lemon ..... 181/290
3,232,371 A * 2/1966 Reichert et al. ..... 181/293
3,786,898 A * 1/1974 Fujii ..... 181/295
3,861,493 A * 1/1975 Payne ..... 181/293
3,968,837 A * 7/1976 Makara ..... 165/135
4,122,915 A * 10/1978 Taguchi ..... 181/284
4,160,491 A * 7/1979 Matsumoto et al. ..... 181/284
4,242,398 A * 12/1980 Segawa et al. ..... 428/172
4,555,433 A * 11/1985 Jablonka et al. ..... 428/166
4,614,680 A * 9/1986 Fry et al. ..... 428/158
4,821,839 A * 4/1989 D'Antonio et al. ..... 181/198
5,160,816 A * 11/1992 Chlop ..... 181/285
5,362,931 A * 11/1994 Fries ..... 181/284
5,401,921 A * 3/1995 D'Antonio et al. ..... 181/286
5,422,446 A * 6/1995 Fries ..... 181/293
5,491,309 A * 2/1996 Kotter ..... 181/285
5,587,564 A * 12/1996 Stief et al. ..... 181/295
5,764,782 A * 6/1998 Hayes ..... 381/160
5,817,992 A * 10/1998 D'Antonio ..... 181/295
5,969,301 A * 10/1999 Cullum et al. ..... 181/286
6,015,026 A * 1/2000 McGrath ..... 181/295
6,035,965 A * 3/2000 Fujiwara et al. ..... 181/293
6,209,680 B1 * 4/2001 Perdue ..... 181/295

(Continued)

*Primary Examiner* — Edgardo San Martin
(74) *Attorney, Agent, or Firm* — Kirton McConkie

(57) ABSTRACT

The present invention relates to providing an acoustic diffuser. In particular, the present invention relates to systems and methods for providing an asymmetric cellular acoustic diffuser adapted to diffuse sound waves that encounter a surface. Further, the present invention relates to providing a system of asymmetric cellular acoustic diffusers adapted to diffuse sound waves that encounter one or more surfaces in an acoustic environment. In some embodiments, an acoustic diffusion device as contemplated herein includes a planer panel having a first portion and a second portion, the first portion and the second portion each having a plurality of cells formed asymmetrically thereon. In such embodiments, the plurality of cells of the first portion is symmetrically oriented in relation to the plurality of cells of the second portion.

20 Claims, 4 Drawing Sheets

U.S. PATENT DOCUMENTS 6,772,857 B2 * 8/2004 Porte et al. ..... 181/210
6,772,859 B2 * 8/2004 D'Antonio et al. ..... 181/293
7,520,370 B2 * 4/2009 Gudim ..... 181/293
7,604,094 B2 * 10/2009 Magyari ..... 181/286
7,721,847 B2 * 5/2010 Coury ..... 181/293
7,963,364 B2 * 6/2011 Nadler et al. ..... 181/293
2003/0006092 A1 * 1/2003 D'Antonio et al. ..... 181/293

* cited by examiner

SYSTEMS AND METHODS FOR PROVIDING AN ASYMMETRIC CELLULAR ACOUSTIC DIFFUSER

RELATED APPLICATIONS

This application claims priority to U.S. Provisional Patent Application Ser. No. 61/293,601 filed Jan. 8, 2010, entitled ASYMMETRIC CELLULAR ACOUSTIC DIFFUSER, which is incorporated herein in its entirety by reference.

BACKGROUND OF THE INVENTION

1. Field of the Invention

The present invention relates to providing an acoustic diffuser. In particular, the present invention relates to systems and methods for providing an asymmetric cellular acoustic diffuser adapted to diffuse sound waves that encounter a surface. Further, the present invention relates to providing a system of asymmetric cellular acoustic diffusers adapted to diffuse sound waves that encounter one or more surfaces in an acoustic environment.

2. Background and Related Art

Generally, acoustical diffusion is the efficacy by which sound energy propagates in a given acoustic environment, including relatively small spaces, such as a bedroom or a hallway, as well as much larger spaces, such as a concert hall or a sports stadium. A perfectly diffusive acoustic environment is one in which various acoustic properties, such as reverberation time, scattering and absorption, are the same everywhere in the acoustic environment. A non-diffuse acoustic environment, on the other hand, is characterized by considerable disparity in acoustic properties at virtually every discrete location within the acoustic environment. For example, as a listener walks around a non-diffuse acoustic environment while sound waves are being transmitted therein, the listener would detect considerable variations in reverberation time and so forth.

Many acoustic environments, such as a bedroom, are naturally non-diffuse or are not perfectly diffuse. Small acoustic environments, in particular, generally have very poor diffusion characteristics. Poor diffusion characteristics in a given acoustic environment can have significant adverse affects on sound waves transmitted therein leading to various sound aberrations, such as echoes. For example, in a relatively small room, such as a personal home theater, poor diffusion characteristics can degrade the quality and clarity of sound associated with a movie or television show broadcast therein, including degrading the dialogue and musical elements. As a second example, in another relatively small space, such as a small recording studio, poor diffusion characteristics can degrade the quality and clarity of sounds sought to be recorded in such a studio, including the recording of musical instruments as well as singing or spoken words.

Attempts have been made to treat traditionally non-diffuse acoustic environments to thereby improve the diffusion characteristics of such environments. For example, since approximately the 1970's various types of acoustic diffusers have been used in such spaces according to a sequence defined by Manfred R. Schroeder. Generally, an acoustic diffuser will cause sound energy to be reflected in several directions, as opposed to a single direction corresponding roughly to the angle of incidence, thereby leading to a more diffusive acoustic space. However, the performance of current devices, such as quadratic residue diffusers or primitive-root diffusers (also known as phase-grating diffusers) is limited. For example, such devices have equal length cavities across their proximal surface which results in a sympathetic absorptive plane caused by the coupling of the equal cavity lengths. The sympathetic absorptive plane results in increased absorption due to the presence of the equal cavity lengths that affects both the quality and quantity of diffusion or scattering and diminishes the effectiveness of such diffusers by reducing the smoothness of the response and the energy reflected by such devices.

Thus, while techniques currently exist that are used to enhance acoustic diffusion, challenges still exist, including improving scattering and diffusion and reducing or eliminating absorption within the operating range of the diffuser. Accordingly, it would be an improvement in the art to augment or even replace current techniques with other techniques.

SUMMARY OF THE INVENTION

The present invention relates to providing an acoustic diffuser. In particular, the present invention relates to systems and methods for providing an asymmetric cellular acoustic diffuser adapted to diffuse sound waves that encounter a surface. Further, the present invention relates to providing a system of asymmetric cellular acoustic diffusers adapted to diffuse sound waves that encounter one or more surfaces in an acoustic environment.

Implementation of the present invention takes place in association with an acoustic diffusion device that includes a planar panel which has two portions (i.e., a first and a second portion). In such implementations, the planer panel further includes numerous cells that are asymmetrically formed on each of the first and second portions of the planar panel, respectively, and the cells of the first portion are symmetrically oriented relative to the cells of the second portion.

In some implementations, the cells are grouped into linear arrays. In such implementations the linear arrays are separated by dividers and the cells grouped within each respective linear array are also separated by dividers. Further, in such implementations, the dividers between the cells are located asymmetrically about an axis defined by the dividers between the linear arrays such that the cells of each adjacent array within either the first portion of the planer panel or the second portion of the planer panel, respectively, are asymmetrical to one another. Moreover, in such implementations, the numerous linear arrays are equal in length to one another.

In further implementations, the edges of the planer panel itself are at least one of square, rounded or chamfered. In other implementations, the ends of the cells are at least one of square, curvilinear, or chamfered.

In some implementations, the cells are configured so as to produce or facilitate one-dimensional diffusion. In other implementations, the cells are configured so as to produce or facilitate two-dimensional diffusion. In the foregoing implementations, the cells themselves remain asymmetrically oriented relative to one another.

In further implementations, an acoustic diffusion device as described above is located within an acoustic environment having one or more surfaces. In such implementations, the acoustic diffusion device is located on one or more of the surfaces of the acoustic environment. In still further implementations, multiple acoustic devices are located within the same acoustic environment on the same surface, on separate surfaces, or on one or more surfaces, respectively.

While the methods and processes of the present invention have proven to be particularly useful in the area of acoustic diffusion devices and systems, those skilled in the art can appreciate that the methods and processes can be used in a variety of different applications and in a variety of different areas of manufacture to yield asymmetric cellular acoustic diffusion surfaces. Some non-limiting examples include constructing the walls of a room or building according to the methods described herein to thereby enhance the diffusive characteristics of the room or building. Alternatively, separate objects, including aesthetic objects, could be collectively oriented on any surface of an acoustic environment to achieve the benefits of the devices and systems described herein.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

In order that the manner in which the above recited and other features and advantages of the present invention are obtained, a more particular description of the invention will be rendered by reference to specific embodiments thereof, which are illustrated in the appended drawings. Understanding that the drawings depict only typical embodiments of the present invention and are not, therefore, to be considered as limiting the scope of the invention, the present invention will be described and explained with additional specificity and detail through the use of the accompanying drawings in which.

DETAILED DESCRIPTION OF THE INVENTION

The present invention relates to providing an acoustic diffuser. In particular, the present invention relates to systems and methods for providing an asymmetric cellular acoustic diffuser adapted to diffuse sound waves that encounter a surface. Further, the present invention relates to providing a system of asymmetric cellular acoustic diffusers adapted to diffuse sound waves that encounter one or more surfaces in an acoustic environment.

Embodiments of the present invention take place in association with an acoustic diffusion device that includes a planar panel which has two portions (i.e., a first and a second portion). In such embodiments, the planer panel further includes numerous cells that are asymmetrically formed on each of the first and second portions of the planar panel, respectively, and the cells of the first portion are symmetrically oriented relative to the cells of the second portion.

In some embodiments, the cells are grouped into linear arrays. In such embodiments the linear arrays are separated by dividers and the cells grouped within each respective linear array are also separated by dividers. Further, in such embodiments, the dividers between the cells are located asymmetrically about an axis defined by the dividers between the linear arrays such that the cells of each adjacent array within either the first portion of the planer panel or the second portion of the planer panel, respectively, are asymmetrical to one another. Moreover, in such embodiments, the numerous linear arrays are equal in length to one another.

In further embodiments, the edges of the planer panel itself are at least one of square, rounded or chamfered. In other embodiments, the ends of the cells are at least one of square, curvilinear, or chamfered.

In some embodiments, the cells are configured so as to produce or facilitate one-dimensional diffusion. In other embodiments, the cells are configured so as to produce or facilitate two-dimensional diffusion. In the foregoing embodiments, the cells themselves remain asymmetrically oriented relative to one another.

In further embodiments, an acoustic diffusion device as described above is located within an acoustic environment having one or more surfaces. In such embodiments, the acoustic diffusion device is located on one or more of the surfaces of the acoustic environment. In still further embodiments, multiple acoustic devices are located within the same acoustic environment on the same surface, on separate surfaces, or on one or more surfaces, respectively.

Figure 1:
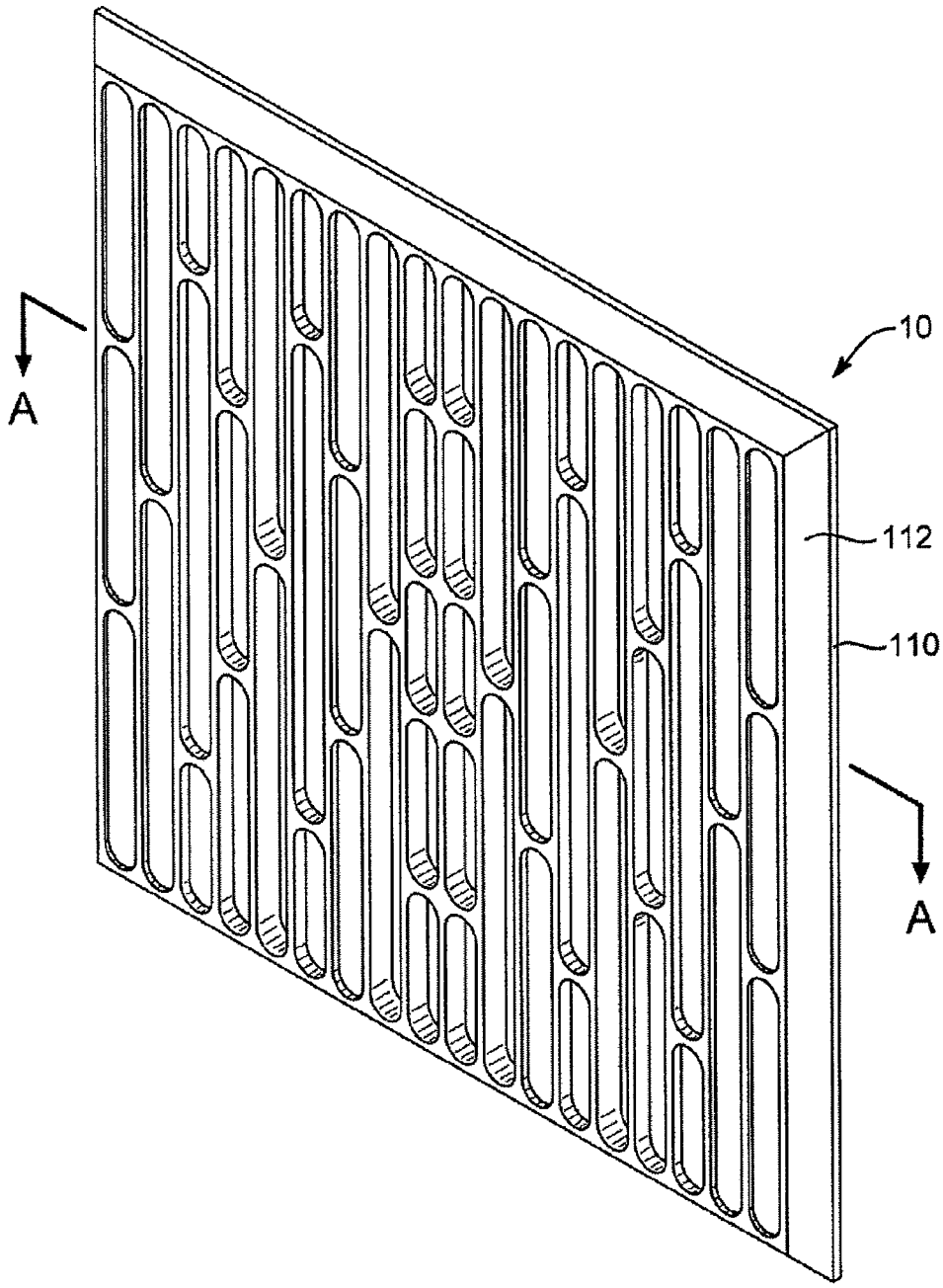
FIG. 1 illustrates an isometric view of a representative asymmetric cellular acoustic diffuser in accordance with an embodiment of the present invention.

With reference now to FIG. 1, a representative embodiment of an acoustic diffusion device 10 is illustrated. As depicted in the embodiment illustrated in FIG. 1, acoustic diffusion device 10 is comprised of a planar panel 110 having a first portion and a second portion (see FIG. 3 at imaginary centerline or axis 20 which lies at the junction of the first and second portions of the planer panel, discussed in greater detail below). In some embodiments, the first portion and the second portion each have numerous cells or slots (also referred to as wells) formed asymmetrically thereon. As illustrated in FIG. 1, in some embodiments, the plurality of cells of the first portion are symmetrically oriented in relation to the plurality of cells of the second portion. The cells illustrated in FIG. 1, including their respective orientations, are discussed in greater detail below.

In some embodiments, acoustic diffusion device 10 depicted in FIG. 1 (device 200 in FIG. 4) is used to control acoustic reflections in any acoustical space, such as a room or other acoustic environment, by providing coherent frequency-based diffusion of sound waves in such an acoustic environment. In some embodiments, acoustic diffusion device 10/200 is mounted to any surface or surfaces within an acoustic environment. Some non-limiting examples of such surfaces include walls, ceilings, floors, doors, balconies, mezzanines, stages, free standing or stand-alone mounting assemblies and other surfaces in any acoustic environment. In some embodiments, one or more acoustic diffusion devices, including at least one acoustic diffusion device 10/200, are mounted in the same acoustic environment on either the same or different surfaces.

With continued reference to FIG. 1, acoustic diffusion device 10 is constructed having any desired dimensions. Such dimensions include height, width, length, and depth. In some embodiments, the dimensions are determined or dictated by design requirements. As one non-limiting example, where acoustic diffusion device 10 is intended for a particular location, the physical constraints of that location impose an outer limit on the various dimensions of the device. In another non-limiting example, where acoustic diffusion device 10 is intended to diffuse, or to enhance diffusion, of a specific acoustical frequency or range of frequencies, the particular frequency or range of frequencies impose constraints on the dimensions of acoustic diffusion device 10. In some embodiments, other design requirements dictate the dimensions of acoustic diffusion device 10.

In some embodiments, acoustic diffusion device 10 is constructed or made of any desirable or suitable material or combination of such materials. Some non-limiting examples of such materials include wood materials, metallic materials, fiberglass, carbon fiber, other fibrous materials, various composite materials, synthetic materials, polymer materials, ceramic materials, plaster, resins, thermoplastics, thermosetting plastics, acrylics, foams and combinations of any or all of the foregoing. In some embodiments, the material selected is selected to enhance the acoustical properties or characteristics of acoustic diffusion device 10. In other embodiments, the material is selected based on aesthetics. For example, a particular type of wood, such as mahogany, may be selected to accommodate a desirable aesthetic appearance.

In some embodiments, acoustic diffusion device 10 is constructed by any suitable method. In some embodiments, the suitable method is dictated by the material selected. By way of non-limiting example, some embodiments of acoustic diffusion device 10 are machined, milled, carved, or otherwise cut out of a solid homogenous stock material or solid core product. Other embodiments of acoustic diffusion device 10 are formed by vacuum forming, thermoforming, rotational molding, injection molding or any other molding or casting processes. In yet other embodiments, acoustic diffusion device 10 is constructed by assembling or combining discrete parts or individual components. As a non-limiting example, some embodiments of acoustic diffusion device 10 are constructed out of metal components that are welded together or wood components that are glued together. Alternative embodiments are constructed using ultrasonic welding and other permanent methods for affixing similar or dissimilar materials together. In yet other embodiments, acoustic diffusion device 10 is constructed out of discrete component elements or parts using semi-permanent or removable attachment means such as snaps, buttons, screws, nails, nuts, bolts, Velcro, and other semi-permanent or removable adhesives and/or attachment devices.

With continued reference to FIG. 1, some embodiments of acoustic diffusion device 10 are constructed with additional features which either enhance the acoustical properties of the device, the aesthetic appearance of the device, or both. By way of non-limiting example, some embodiments of acoustic diffusion device 10 comprise edges 112 which are at least one of square, rounded with any desirable radius, or chamfered/beveled at any desirable angle (a non-limiting example of a chamfered edge 112 is clearly shown in FIG. 2). In some embodiments, whether edges 112 are square, rounded (including the appropriate radius), or chamfered (including the appropriate angle) is determined by design requirements as discussed above and elsewhere. In other embodiments, edges 112 are covered or wrapped in a suitable material. In yet other embodiments, edges 112 are engraved or inlayed with suitable elements for acoustical or aesthetic purposes.

Figure 2:
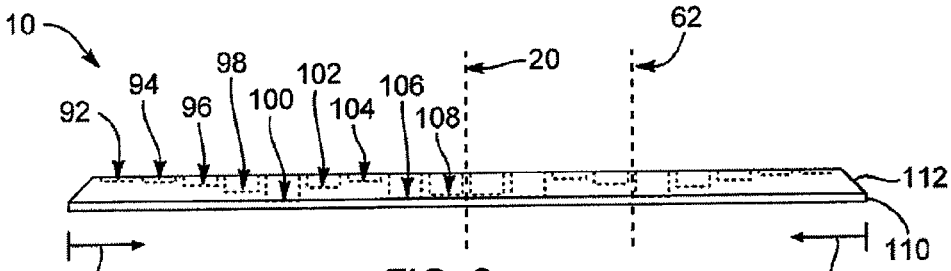
FIG. 2 illustrates a cross-sectional view taken along line A-A of the embodiment depicted in FIG. 1.

Turning now to FIG. 2, an embodiment of acoustic diffusion device 10 is depicted in a cross-sectional view taken along line A-A shown in FIG. 1. As mentioned above, some embodiments of acoustic diffusion device 10 include numerous cells or slots. As shown clearly in FIG. 2, in some embodiments the cells have varying depths depending on design requirements as discussed above and elsewhere. For example, the left most cell has a depth 92 that is either similar, dissimilar or identical to depths 94, 96, 98, 100, 102, 104, 106, and/or 108 depending on various design requirements and considerations. In some embodiments, the cell depths 92, 94, 96, 98, 100, 102, 104, 106, and/or 108 are equal. In other embodiments, the depths of only some cells are equal to each other. Still, in other embodiments, each cell depth varies based on design requirements. The cell depth of the deepest cell (depth 100 in the non-limiting embodiment depicted in FIG. 2) determines the lowest acoustic frequency capable of being diffused by the acoustic diffusion device 10 based-on one-quarter wavelength of the acoustic frequency at issue. The cell dimensions, including depth, width and length will be discussed in greater detail below.

Figure 3:
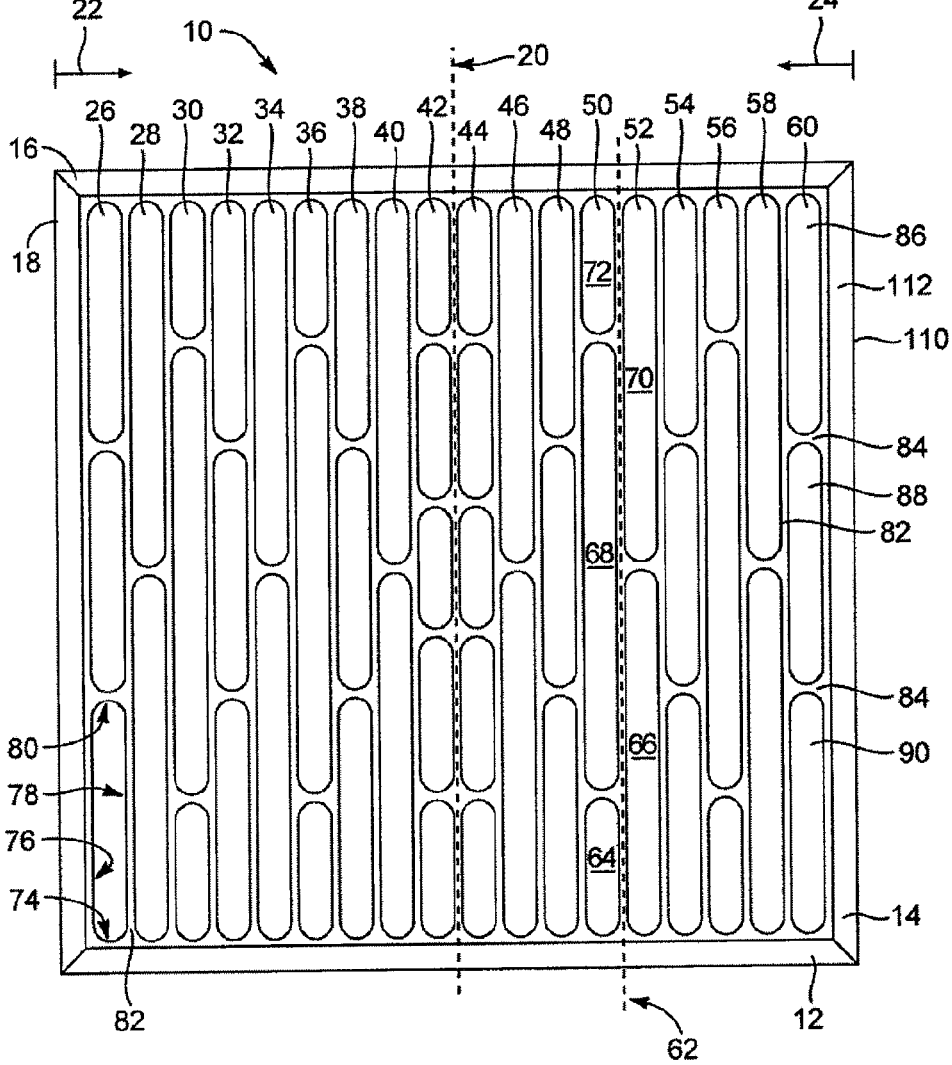
FIG. 3 illustrates a front view of the embodiment depicted in FIGS. 1 and 2.

In some embodiments, as clearly depicted by way of non-limiting example in FIG. 2, the cells have square edges (including both the proximal or external edges and the distal or internal edges). However, in other embodiments, the edges of the cells (including both the proximal edges as well as the distal edges) are curvilinear or otherwise rounded having any desirable radius. In yet other embodiments, the cell edges referenced above are chamfered or otherwise beveled having any desirable angle. In some embodiments, whether the edges of the cells referenced above are square, rounded (including the appropriate radius), or chamfered (including the appropriate angle) is determined by design requirements as discussed above and elsewhere. In alternative embodiments, the cell edges are configured based on aesthetic interests. In some embodiments where the distal edges of the cells are rounded or chamfered, the distal or internal surface of the cells are non-uniform or curvilinear depending on the edge shape selected as discussed above. For example, in some embodiments having curvilinear or rounded distal edges, the profile of the distal surface of the cell (when viewed from the angle shown in cross-sectional view in FIG. 2) forms a rounded or cupping "U" shape. Alternatively, in some embodiments having chamfered or beveled distal edges, the profile of the distal surface of the cell (when viewed from the angle shown in cross-sectional view in FIG. 2) forms a triangular or notched "V" shape. With reference now to FIG. 3, a front view of an embodiment of acoustic diffusion device 10 is depicted. As illustrated in FIG. 3, some embodiments of acoustic diffusion device 10 include sides 12, 14, 16 and 18. For convenience in discussing sides 12, 14, 16, and 18, side 12 will be referred to hereinafter as the "bottom," side 14 will be referred to hereinafter as the "right side," side 16 will be referred to hereinafter as the "top," and side 18 will be referred to hereinafter as the "left side." While the terms bottom, top, left side and right side are used for convenience, such terms are not intended to be limiting. For example, in some embodiments, acoustic diffusion device 10 is oriented such that "top" 16 is located where "left side" 18 appears in FIG. 3, and so forth. Alternatively, in some embodiments acoustic diffusion device 10 is oriented such that there is no discernable "top" or "bottom," such as when acoustic diffusion device 10 is located or otherwise secured on a ceiling.

In some embodiments, top 16, left side 18, right side 14, and bottom 12 are substantially flat and oriented relative to one another at right angles. In such embodiments, for example, the junction of top 16 and left side 18 forms a 90-degree right angle. In other embodiments, however, top 16, left side 18, bottom 12, and right side 14 are oriented differently such that acoustic diffusion device 10 has an alternative shape. Some non-limiting examples of such shapes include a parallelogram, a quadrilateral, a rhombus and other similar four sided shapes. In yet other embodiments, acoustic diffusion device 10 includes fewer than four sides or more than four sides depending on design requirements and aesthetic appeal. For example, in some embodiments acoustic diffusion device 10 comprises the shape of a pentagon or a triangle. Moreover, in some embodiments, top 16, left side 18, bottom 12, and right side 14 are configured with fanciful designs, shapes, or edge treatments.

With continued reference to FIG. 3, some embodiments of acoustic diffusion device 10 have a proximal planer surface that is substantially flat but for the cells or slots formed thereon. As referenced above, in some embodiments planar panel 110 has numerous cells, or a plurality of cells, formed thereon. The characteristics of the cells in some embodiments have been discussed previously. While the features discussed with reference to the various cells only refer to one representative cell or another in the corresponding figures, in some embodiments each of the individual cells have the same, different, similar or dissimilar features as those described throughout this disclosure. In addition to features previously discussed, some embodiments include cells having sides 74, 76, 78, and 80. As mentioned above, side 74 will be referred to hereinafter as the "bottom end," side 76 will be referred to hereinafter as the "left edge," side 78 will be referred to hereinafter as the "right edge," and side 80 will be referred to hereinafter as the "top end." Again, such monikers are non-limiting; rather, such are used simply for convenience.

In some embodiments, left edge 76 and right edge 78 are parallel to left side 18 and right side 14 and perpendicular to top 16 and bottom 12. In other embodiments, the cells are positioned in alternative orientations as desired or necessary according to design requirements.

With continued reference to the cell features as illustrated in FIG. 3, in some embodiments cell top end 80 and cell bottom end 74 have round, circular or curvilinear profiles, having any desirable radius, thereby forming "U" shapes when viewed as in FIG. 3. However, in other embodiments, top end 80 and bottom end 74 are square, forming right angles with left edge 76 and right edge 78, respectively. In yet other embodiments, top end 80 and bottom end 74 are chamfered or otherwise beveled having any desirable angle. In such embodiments, the profile of top end 80 and bottom end 74, when viewed as in FIG. 3, form a triangular or notched "V" shape. In some embodiments, whether top end 80 and bottom end 74 are square, rounded (including the appropriate radius), or chamfered (including the appropriate angle) is determined by design requirements as discussed above and elsewhere. In alternative embodiments, top end 80 and bottom end 74 are configured based on aesthetic appeal. While top end 80 and bottom end 74 have been discussed together herein for the sake of convenience, top end 80 and bottom end 74 have similar shapes and configurations to one another in some embodiments while having different shapes and configurations from one another in other embodiments. With continued reference to FIG. 3, in some embodiments the plurality of cells configured or formed on planer panel 110 are grouped into numerous adjacent linear arrays 26, 28, 30, 32, 34, 36, 38, 40, 42, 44, 46, 48, 50, 52, 54, 56, 58, and 60. For convenience, the plurality of adjacent linear arrays extending between left side 18 of planer panel 110 and imaginary centerline 20 will be referred to collectively as elements 26-42 while the plurality of adjacent linear arrays extending between right side 14 and centerline 20 will be referred to collectively as elements 44-60. For additional convenience, all of the plurality of linear arrays will be referred to collectively as elements 26-60. While each of the plurality of linear arrays 26-60 are composed of numerous, albeit a varying number, of cells, in some embodiments each of the plurality of adjacent linear arrays are equal in length. In other words, the total, overall length of each linear array of cells is equal. For example, linear array 26 is composed of three cells while linear array 28 is composed of only two cells but the overall length of linear arrays 26 and 28 is the same. In some embodiments, the length of each individual cell within each linear array, which in some embodiments are equal, varies and/or is modifiable.

In some embodiments, the plurality of adjacent linear arrays 26-60 are separated by numerous array dividers. A representative array divider is illustrated at 82. In some embodiments, each of the plurality of array dividers comprise the same, different, similar or dissimilar features as those described with reference to representative array divider 82. In some embodiments, the plurality of array dividers are formed by removing material to form the cell cavities, such as by milling or machining, as discussed above. In other embodiments, the plurality of array dividers are separate parts that are assembled with other separate components to form acoustic diffusion device 10. In some embodiments, the dimensions of the array dividers vary. Such variations include variations in length, width and depth depending on design requirements.

Similarly, in some embodiments, the plurality of cells grouped into each discrete linear array are separated by numerous cell dividers. A representative cell divider is illustrated at 84. In some embodiments, each of the plurality of cell dividers have the same, different, similar or dissimilar features as those described with reference to representative cell divider 84. In some embodiments, the plurality of cell dividers are formed by removing material to form the cell cavities, such as by milling or machining, as discussed above. In other embodiments, the plurality of cell dividers are separate parts that are assembled with other separate components to form acoustic diffusion device 10. In some embodiments the dimensions of the cell dividers vary. Such variations include variations in length, width and depth depending on design requirements.

In some embodiments, the cells in the linear arrays are configured such that acoustic diffusion device 10 produces one-dimensional diffusion.

In other embodiments, the cells are modified such that acoustic diffusion device 10 produces two-dimensional diffusion. In some embodiments, each cell has the same length and width, but the depths of the cells vary and the cells themselves remain asymmetrically oriented relative to one another.

With continued reference to FIG. 3, as mentioned above, in some embodiments the planer panel 10 is comprised of two portions, a first portion defined as between left side 18 and centerline 20 and a second portion defined as between right side 14 and centerline 20. In some embodiments, each of the plurality of cell dividers (e.g. 84) located on the first portion are positioned or located asymmetrically about an axis defined by each of the plurality of array dividers (e.g. 82) of the first portion. Likewise, in such embodiments, each of the plurality of cell dividers (e.g. 84) located on the second portion are positioned or located asymmetrically about an axis defined by each of the plurality of array dividers (e.g. 82) of the second portion. In this manner, each cell in the linear arrays of the first portion is asymmetrically oriented relative to every immediately adjacent cell in the adjacent linear array(s) of the first portion. Likewise, each cell in the linear arrays of the second portion is asymmetrically oriented relative to every immediately adjacent cell in the adjacent linear array(s) of the second portion. In other words, in some embodiments, the cell dividers of the first portion are asymmetrically oriented with respect to every adjacent cell divider of the first portion, and the cell dividers of the second portion are asymmetrically oriented with respect to every adjacent cell divider of the second portion. In this way, the cells of the first portion are asymmetrically oriented relative to the immediately adjacent cells of the first portion, and the cells of the second portion are asymmetrically oriented relative to the immediately adjacent cells of the second portion.

For example, in some embodiments linear array 60 is comprised of three cells 86, 88, and 90. Adjacent linear array 58 is composed of only two cells, and the two cells of linear array 58 are asymmetrically oriented relative to the three cells of linear array 60 such that the cells dividers 84 between cells 86, 88, and 90 are asymmetrically oriented relative to the single cell divider of linear array 58. As another example, in some embodiments linear array 50 is composed of three cells 64, 68, and 72. Adjacent linear array 52 is composed of two cells 66 and 70. Linear arrays 50 and 52 are separated by an array divider with imaginary line 62 drawn through it. The array divider corresponding to the location of line 62 defines an axis about which cells 64, 66, 68, 70, and 72 are formed such that cells 64, 68, and 72 are asymmetrically oriented relative to cells 66 and 70.

In some embodiments, the individual cell lengths are varied and/or modified so long as each individual cell remains asymmetrical, or of unequal length, to every other adjacent cell located on the same portion of the planer panel 110. For example, in some embodiments, linear array 52 is modified to include four cells, each cell having a shorter length than cells 66 and 70, while linear array 50 is modified to include two cells, each cell having a longer length than cells 64 and 72, but having a shorter length than cell 68. So long as the modified cells remained asymmetrically oriented or of unequal length relative to every adjacent cell located about the axis 62, respectively, such a device is consistent with the spirit and/or characteristics of the present invention. The asymmetry of the cells within each portion of planer panel 110, as discussed with reference to various embodiments above, contribute to the decoupling of acoustic diffusion device 10 such that the acoustic characteristics of acoustic diffusion device 10, such as absorption and scattering, are enhanced. Put differently, in some embodiments, the overall length of each linear array, which has an equal depth and width in some embodiments, is separated into separate, smaller, non-equal length adjacent cells. In such embodiments, absorption is reduced while scattering is increased within the operating range of the diffuser.

In some embodiments, linear arrays 26-42 formed on the portion of planer panel 110 between left side 18 and centerline 20 are mirror images of linear arrays 44-60 formed on the opposing portion of the planer panel 110 between right side 14 and centerline 20. Put differently, in some embodiments, linear arrays 26-42 are formed having a pattern in direction 22 from left side 18 toward centerline 20 while linear arrays 44-60 are formed having the mirror image pattern in direction 24 from right side 14 to centerline 20. In this way, the linear arrays on the first portion of planer panel 110 are symmetrically oriented in relation to the linear arrays on the second portion of the planer panel 110 about centerline 20. Thus, in some embodiments, for example, linear array 26 is the mirror image of linear array 60 about centerline 20, linear array 28 is the mirror image of linear array 58 about centerline 20 and so forth until one reaches the centerline 20 about which linear array 42 is the mirror image of linear array 44. Moreover, in some embodiments, the depths 92, 94, 96, 98, 100, 102, 104, 106 and 108 corresponding to linear arrays 26-42, respectively, are mirror images of the depths corresponding to linear arrays 44-60. In this way, the cells of the first portion are symmetrically oriented in relation to the cells of the second portion of the planer panel 110.

In some embodiments, each linear array of cells 26-60 conforms to the quadratic residue diffuser (QRD) equation, which defines the well depth proportionality factor equaling [$N^2$ modulo p], where "p" equals a prime number and "n" equals a whole number between zero and infinity. In some embodiments, the QRD equation determines the depth of each adjacent well or cell, and their sequence, as defined by Schroeder. One of skill in the art will recognize that the QRD equation is variable depending on the whole number chosen to define the sequence (i.e. 5, 7, 11, 13, 17, 19, 23 . . . x, where "x" equals the continuation of the sequence defined by the QRD equation depending on the whole number chosen).

In some embodiments, the depth of the cells is determined by the primitive root diffusion equation sequence, and its related prime number, chosen to determine the finite nature of the diffusion. The primitive root diffuser equation defines the well depth proportionality factor Gn modulo p in which "p" equals a prime number and "G" equals the least primitive root of "p." As mentioned above, in some embodiments the QRD equation and/or the primitive root diffuser equation determine the depth of each adjacent cell or well, and the sequence of the linear arrays of cells, as defined by Schroeder.

As mentioned above, the depth of the deepest cell in the design sequence, as defined by the QRD equation in some embodiments, determines the lowest frequency capable of being diffused by such an embodiment according to the QRD sequence at one-quarter wavelength. The width of the interior of each cell determines the highest frequency which can be diffused based on one-half of the wavelength. In some embodiments, the cell widths are approximately one-half the wavelength of the shortest wavelength to be scattered or diffused. The length, width, and depth of each cell grouped into a linear array define the volume of each such cell. The length, depth, width, and corresponding volume considerations discussed above, particularly with reference to the QRD and primitive root equations, are considered part of the design considerations discussed with reference to various embodiments throughout this disclosure. Further, in some embodiments, such design considerations are based on the division of depths of cells based on the depth divided by the whole number chosen in connection with the QRD equation.

Figure 4:
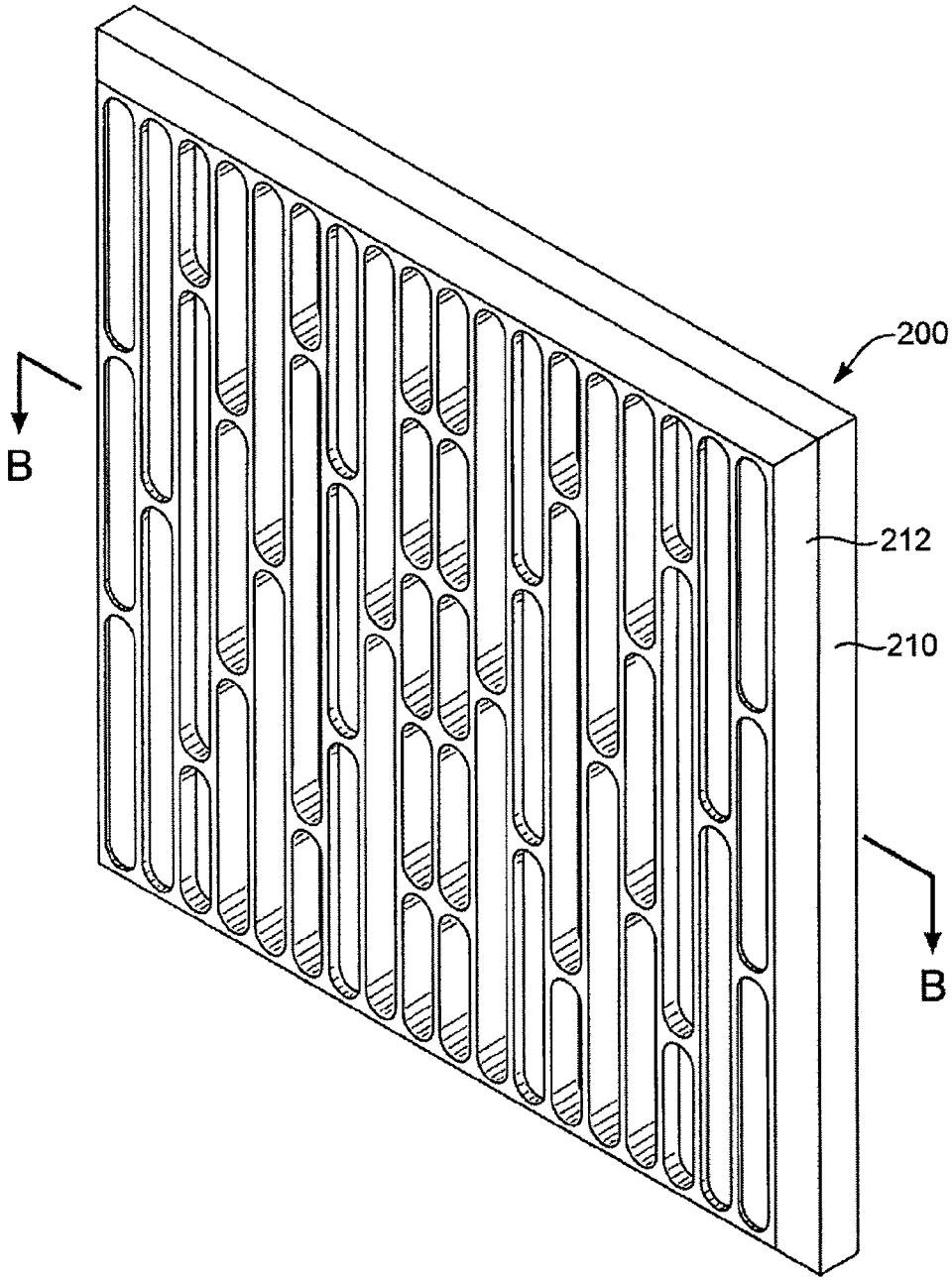
FIG. 4 illustrates an isometric view of a representative asymmetric cellular acoustic diffuser in accordance with another embodiment of the present invention.
Figure 5:
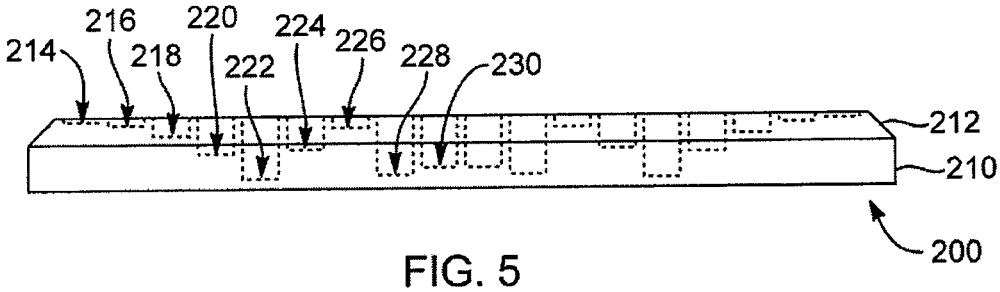
FIG. 5 illustrates a cross-sectional view taken along line B-B of the embodiment depicted in FIG. 4.
Figure 6:
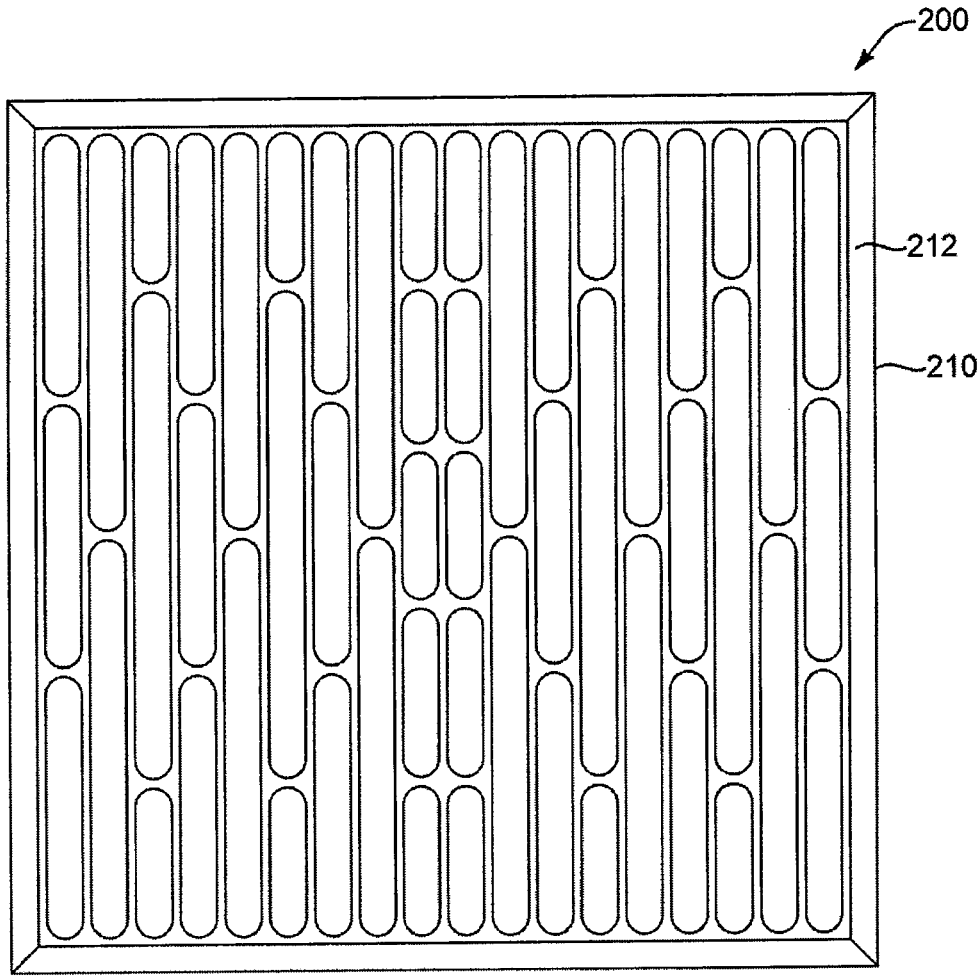
FIG. 6 illustrates a front view of the embodiment depicted in FIGS. 4 and 5.

With reference to FIGS. 4 through 6, an alternative embodiment is illustrated. As depicted in FIGS. 4-6, in some embodiments, acoustic diffusion device 200 is manufactured to any desired depth and the cells depths are also modifiable as illustrated by depths 214, 216, 218, 220, 222, 224, 226, 228, and 230 (see FIG. 5, a cross-sectional view taken about line B-B of FIG. 4).

While embodiments of the present invention have been discussed with reference to the figures which illustrate a select number of linear arrays and a select number of individual cells having a certain length, width, shape, depth and so forth, one of skill in the art will recognize that embodiments of the present invention are not limited to size, sequence number, number of cells, and like parameters. Rather, all such features are modifiable within the spirit of the invention according to various design considerations as discussed throughout this disclosure. For example, in some embodiments, the acoustic diffusion device 10/200 is modified by changing the sequence number, the number of cells in the design based on a prime number sequence, the number and pattern of cells in each linear array, the depth of the cells from both left to right and top to bottom of acoustic diffusion device 10 and so forth. In other embodiments, alternations and modifications are used to achieve enhanced one-dimensional diffusion while in other embodiments alternative modifications are used to achieve enhanced two-dimensional diffusion. In yet other embodiments, modifying the cell depths and/or widths changes the frequency range and response of the acoustic diffusion device 10/200.

Thus, as discussed herein, the embodiments of the present invention embrace asymmetric cellular acoustic diffusers and systems and methods for providing asymmetric cellular acoustic diffusers.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. An acoustic diffusion device, comprising:

a planar panel having a plurality of columns of cells formed therein, each cell having a depth;

wherein the length of cells in one column is different from the length of cells in any adjacent column; and wherein the plurality of columns are arranged into a first portion on one side of an axis and a second portion on the other side of the axis, the first and second portions being symmetrical about the axis.

2. An acoustic diffusion device as recited in claim 1, wherein the depth of each cell in the planar panel is based on either the quadratic residue diffuser equation or the primitive root diffusion equation.

3. An acoustic diffusion device as recited in claim 1, wherein adjacent columns are separated by a divider.

4. An acoustic diffusion device as recited in claim 3, wherein the width of a divider between one set of adjacent columns is the same as the width of a divider between another set of adjacent columns.

5. An acoustic diffusion device as recited in claim 1, wherein adjacent cells within a column are separated by a divider.

6. An acoustic diffusion device as recited in claim 5, wherein the distance between two adjacent cells within a column is at least as great as the width of the two adjacent cells.

7. An acoustic diffusion device as recited in claim 1, wherein the length of a cell in one column is no greater than three times the length of a cell in an adjacent column.

8. An acoustic diffusion device as recited in claim 1, wherein at least one edge of the planar panel is one of: (i) rounded; (ii) square; and (iii) chamfered.

9. An acoustic diffusion device as recited in claim 1, wherein a top end and a bottom end of at least some of the cells in one more columns is one of: (i) square; (ii) curvilinear; or (iii) chamfered.

10. An acoustic diffusion device as recited in claim 1, wherein the acoustic diffusion device produces one-dimensional diffusion.

11. An acoustic diffusion device as recited in claim 1, wherein the acoustic diffusion device produces two-dimensional diffusion.

12. An acoustic diffusion device as recited in claim 1, wherein the widths of the cells in a particular column are equal.

13. An acoustic diffusion device as recited in claim 1, wherein adjacent cells within a column are separated by a cell divider, and adjacent columns are separated by a column divider, wherein the cell dividers and the column dividers have a width of less than 0.5 inches.

14. An acoustic diffusion device as recited in claim 1, wherein the cells are of various depths.

15. An acoustic diffusion device as recited in claim 1, wherein the width of each cell is no greater than 1.5 inches.

16. An acoustic diffusion device as recited in claim 1, wherein each column has an equal length.

17. An acoustic diffusion device as recited in claim 1, wherein at least some columns contain a different number of cells than another column.

18. An acoustic diffusion device as recited in claim 1, wherein the planar panel is constructed out of a material selected from the group consisting of wood, metal, fiberglass, carbon fiber, plaster, composites, synthetics, polymers, resins, thermoplastics, thermosetting plastics, ceramics, foams, and acrylics.

19. An acoustic diffusion device comprising:

a panel having a planar surface in which is formed a first set of columns of cells and a second set of columns of cells, the first and second sets of columns being arranged on opposite sides of an axis, each cell having a depth with respect to the planar surface, wherein the cells in each column are configured to have a length that is different from the length of any cell in an adjacent column, and wherein the first and second set of columns are symmetrical about the axis.

20. The acoustic diffusion device of claim 19, wherein the length of a cell in one column is no greater than three times the length of a cell in an adjacent column, and wherein the distance between two cells in a column is no greater than the width of the two cells.

* * * * *